US011046542B2

(12) United States Patent
Mora Flores

(10) Patent No.: US 11,046,542 B2
(45) Date of Patent: Jun. 29, 2021

(54) WEB FILM MOVEMENT COMPENSATING DEVICE FOR A WEB FILM MOVEMENT COMPENSATION BETWEEN A CONTINUOUS FORWARD MOVEMENT SECTION AND AN INTERMITTENT FORWARD MOVEMENT SECTION

(71) Applicant: MESPACK, SL, Santa Perpetua de Mogoda (ES)

(72) Inventor: Francisco Mora Flores, Mollet del Valles (ES)

( * ) Notice: Subject to any disclaimer, the term of this patent is extended or adjusted under 35 U.S.C. 154(b) by 140 days.

(21) Appl. No.: 16/603,094

(22) PCT Filed: Apr. 4, 2018

(86) PCT No.: PCT/EP2018/058573
§ 371 (c)(1),
(2) Date: Oct. 4, 2019

(87) PCT Pub. No.: WO2018/185141
PCT Pub. Date: Oct. 11, 2018

(65) Prior Publication Data

US 2020/0071110 A1 Mar. 5, 2020

(30) Foreign Application Priority Data

Apr. 7, 2017 (EP) ..... 17382191

(51) Int. Cl.
*B65H 20/34* (2006.01)
*B65B 41/12* (2006.01)
(Continued)

(52) U.S. Cl.
CPC ..... *B65H 20/34* (2013.01); *B65B 41/12* (2013.01); *B65H 20/24* (2013.01); *B65H 23/16* (2013.01);
(Continued)

(58) Field of Classification Search
CPC ..... B65H 20/24; B65H 20/34; B65H 23/16; B65H 2408/2171; B65H 2408/2172
See application file for complete search history.

(56) References Cited

U.S. PATENT DOCUMENTS 3,540,641 A 11/1970 Besnyo
2013/0001349 A1 1/2013 Pedercini

FOREIGN PATENT DOCUMENTS

DE 19848519 A1 * 5/2000 ..... B65H 23/1955
EP 0510251 A1 10/1992
(Continued)

*Primary Examiner* — William E Dondero
(74) *Attorney, Agent, or Firm* — Eugenio J. Torres-Oyola; Victor M. Rodriguez-Reyes; Rafael Rodriguez-Muriel

(57) ABSTRACT

The present invention relates to a web film movement compensating device for a web film movement compensation between continuous forward movement section and intermittent forward movement section comprising two guide rollers (1, 2) rotating freely in stationary positions between a continuous driving device (5) and an intermittent driving device (6), two compensation rollers (3, 4) rotating freely on two respective pivoting arms (7, 8) oscillating about pivot shafts (11, 12), an elastic element (9) connected to one of the pivoting arms to actuate the corresponding compensation roller to move away from the guide rollers, and a movement transmission mechanism including lever arms and transmission rods (13, 14, 15) transmitting an oscillating movement from one of the pivoting arms (7, 8) to the other. A web film (50) moved by the driving devices is supported on the guide rollers (1, 2) and on the compensation rollers (3, 4) forming a meander.

6 Claims, 3 Drawing Sheets

(51) Int. Cl.
*B65H 20/24* (2006.01)
*B65H 23/16* (2006.01)

(52) U.S. Cl.
CPC ..... *B65H 2408/2171* (2013.01); *B65H 2408/2172* (2013.01)

(56) References Cited

FOREIGN PATENT DOCUMENTS

| | | | |
|---|---|---|---|
| EP | 0694492 | A2 | 1/1996 |
| EP | 2463218 | A1 | 6/2012 |

* cited by examiner

WEB FILM MOVEMENT COMPENSATING DEVICE FOR A WEB FILM MOVEMENT COMPENSATION BETWEEN A CONTINUOUS FORWARD MOVEMENT SECTION AND AN INTERMITTENT FORWARD MOVEMENT SECTION

FIELD OF THE ART

The present invention relates to a web film movement compensating device for a web film movement compensation between a continuous forward movement section and an intermittent forward movement section useful for an automatic horizontal bag-forming and -filling machine.

BACKGROUND OF THE INVENTION

Machines, such as automatic horizontal-type bag-forming and -filling machines, for example, are known to comprise a continuous driving device causing a web film to move forward with a continuous movement into a section with continuous forward movement along which units of the machine perform specific operations on the web film, such as folding and superposing parts of the band, for example, which require the web film to be in motion, and an intermittent driving device causing the web film to move forward with an intermittent movement into a section with intermittent forward movement along which other units of the machine perform other operations on the web film, such as welding and cutting the web film, for example for forming individual bags, which require the web film to be stopped.

Machines of this type generally include a web film movement compensating device for web film movement compensation between the sections with continuous forward movement and with intermittent forward movement.

A movement compensating device of a known type comprises two guide rollers parallel to one another arranged such that they can rotate freely in stationary positions between the continuous driving device and the intermittent driving device, a compensation roller parallel to the guide rollers installed such that it can rotate freely on a pivoting arm oscillating about a pivot shaft parallel to the guide rollers, and an elastic element connected to the pivoting arm to actuate the compensation roller in a direction of moving away from the guide rollers. The web film is supported on the guide rollers and on the compensation roller forming a meander and the pivoting arm performs an oscillating movement causing an increase in the meander as a result of a force exerted by the elastic element when the intermittent driving device is stopped and a decrease in the meander against the force of the elastic element when the intermittent driving device is in operation.

This type of movement compensating device with a single compensation roller installed in a single pivoting arm has several determining factors that require a compromise solution. The mass of the compensation roller in combination with the oscillating movement of the pivoting arm causes inertial forces which increase the longer the pivoting arm is. On the other hand, the shorter the pivoting arm is, the higher the amplitude of the oscillating movement has to be in order to provide the required meander, and a high-amplitude oscillating movement requires greater angular accelerations and velocities of the pivoting arm and furthermore causes greater variation in the angle at which the web film surrounds the guide rollers in the course of each cycle.

Patent documents EP 23117 A1, ES 8605439 A1 and GB 1332544 A disclose compensating devices similar to the one described above in which there is a plurality of guide rollers in fixed positions and a plurality of compensation rollers installed on a single pivoting arm such that the web film forms several meanders.

Patent document U.S. Pat. No. 3,540,641 discloses a web accumulator for maintaining approximately uniform tension in an advancing web. The accumulator has a pair of opposed arms which are mounted for swinging movement at opposite ends of a frame. The arms each have a plurality of rollers at spaced intervals. The web is conducted alternately over a roll at the outer end of one arm and a roll at the inner end of the other arm and progressively back and forth over the rollers of both arms and then off of the frame at the opposite end. The arms swing in coordinated relation to provide wide variation of spacing. A power device applying torque to the arms causes the arms to swing when the tension in the web changes.

Patent document EP0510251 A1 discloses a web accumulator including one pneumatic cylinder actuator and a chain loop connected to opposite ends of its piston rod. Translation of the chain in response to pressurizing the cylinder causes the chain to drive two spaced apart axle shafts in the same rotational direction. An arm is fastened to each axle shah and there is a row of rollers on each arm and a roller on each axle shaft. Web is threaded in loops back and forth between rollers on the respective arms. When the web infeed rate to the accumulator and the outfeed rate at which the web is drawn out by a web consuming device are equal, the regulated air pressure to the actuator drives the arms apart to accumulate a long length of web. When web infeed is interrupted while outfeed or draw persists, the arms are pulled toward each other and they pay out the stored length of web.

Patent document EP2463218A1 discloses An accumulating apparatus having an upper arm in which a plurality of upper rollers are arranged, and a lower arm in which a plurality of lower rollers are arranged. An upper gear is fixed to the upper arm and a lower gear is fixed to the lower arm. The upper gear is engaged with the lower gear, the upper arm and the lower arm are simultaneously moved opposite to each other with respect to a vertical direction by an air cylinder.

Patent document DE19848519A1 discloses a device for compensating the advancing movement of a film web, which is guided between loops in a first group and a second group of guide rollers, wherein the first group of guide rollers is arranged on a first pivoting arm and the second group of guide rollers is arranged on a second pivoting arm. A movement transmission mechanism transmits oscillating movements of the first pivoting arm to said second pivoting arm such that the first and second groups of guide rollers move closer to one another and away from one another simultaneously. An elastic element is connected to each of the first and second pivoting arms to actuate said first and second groups of guide rollers in a direction of moving away from one another.

DISCLOSURE OF THE INVENTION

The present invention provides a web film movement compensating device for a web film movement compensation between a continuous forward movement section and an intermittent forward movement section for an automatic horizontal bag-forming and -filling machine comprising first and second guide rollers parallel to one another arranged such that they can rotate freely in stationary positions between a continuous driving device and an intermittent driving device, first and second compensation rollers parallel to the first and second guide rollers installed such that it can rotate freely about respective first and second pivoting arms oscillating about corresponding first and second pivot shafts parallel to the first and second guide rollers, an elastic element connected to the first pivoting arm to actuate the first compensation roller in a direction of moving away from the first and second guide rollers, and a movement transmission mechanism transmitting the oscillating movement of the first pivoting arm to the second pivoting arm such that the first and second compensation rollers move closer to one another and to the first and second guide rollers and away from one another and from the first and second guide rollers simultaneously.

During operation, a web film, which is moved continuously by the continuous driving device and intermittently by the intermittent driving device, is supported on the first and second guide rollers and on the compensation roller forming a meander while the pivoting arm performs an oscillating movement between a maximum meander position and a minimum meander position.

Optionally, the movement compensating device farther comprises a second elastic element connected to the second pivoting arm to actuate the second compensation roller in a second direction of moving away from the first and second guide rollers opposite the first direction of moving away.

With this arrangement, each of the first and second pivoting arms is significantly shorter and the oscillating movement thereof has a smaller amplitude compared with the single pivoting arm existing in the compensating devices of the prior art for achieving a comparable meander. Accordingly, compared with compensating devices of the prior art, the movement compensating device of the present invention generates less inertial forces and has a smaller variation in the angle at which the web film surrounds the guide rollers in the course of each cycle.

It must be pointed out that the compensating device of the present invention works exactly the same both when the inward movement is the continuous movement and the outward movement is the intermittent movement and when the inward movement is the intermittent movement and the outward movement is the continuous movement.

The first pivot shaft is closer to the first guide roller than to the second guide roller on a first side of a geometric plane containing axes of the first and second guide rollers and the second pivot shaft is closer to the second guide roller than to the first guide roller on a second side of the geometric plane containing the axes of the first and second guide rollers.

In one embodiment the first and second guide rollers and the first and second pivot shafts are arranged in symmetrical positions with respect to an axis of symmetry parallel to and equidistant from the first and second guide rollers and contained in the geometric plane containing the axes of the first and second guide rollers. Also preferably, the first and second compensation rollers have one and the same diameter and the first and second pivoting arms have one and the same length.

The movement transmission mechanism comprises a first lever arm fixed to the first pivoting arm, a second lever arm fixed to the second pivoting arm, and a connecting rod having a first end connected to the first lever arm by a first articulation and a second end connected to the second lever arm by a second articulation. Preferably, the first and second lever arms have one and the same length and the connecting rod has a length equal to a distance between the first and second pivot shafts.

The elastic element, or each of the first and second elastic elements, can be made up of a device with a pneumatic spring, a tension coil spring, a compression coil spring, a torsion coil spring, or any other type of spring.

The continuous driving device and the intermittent driving device belong to the automatic horizontal bag-forming and -filling machine and are not part of the present invention.

BRIEF DESCRIPTION OF THE DRAWINGS

The foregoing and other features and advantages will be better understood based on the following detailed description of a merely illustrative and non-limiting embodiment in reference to the attached drawings, in which.

DETAILED DESCRIPTION OF AN EMBODIMENT

Figure 1:
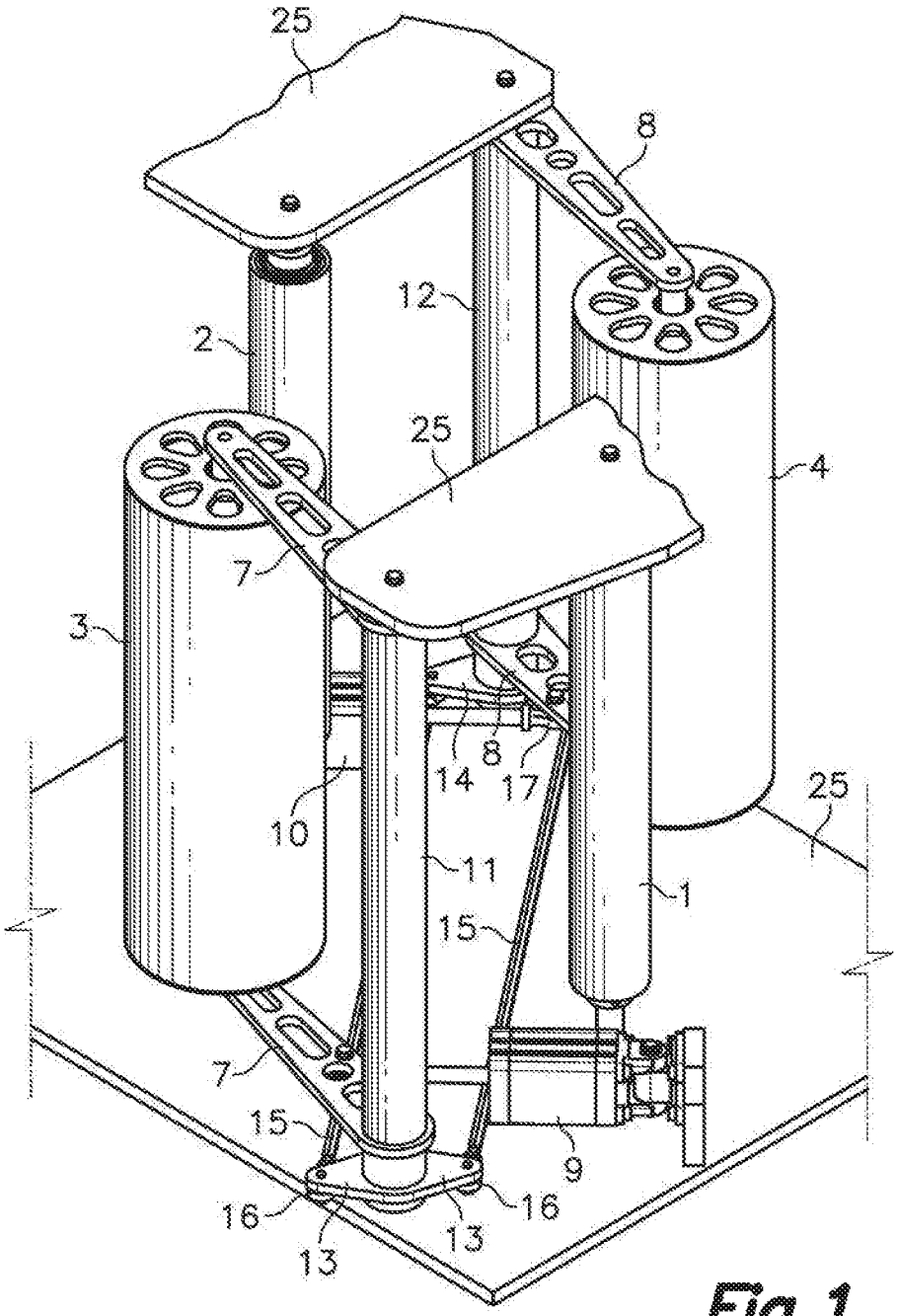
FIG. 1 is a perspective view of a movement compensating device compensating for the movement of a web film between sections with continuous forward movement and intermittent forward movement according to an embodiment of the present invention.
Figure 2:
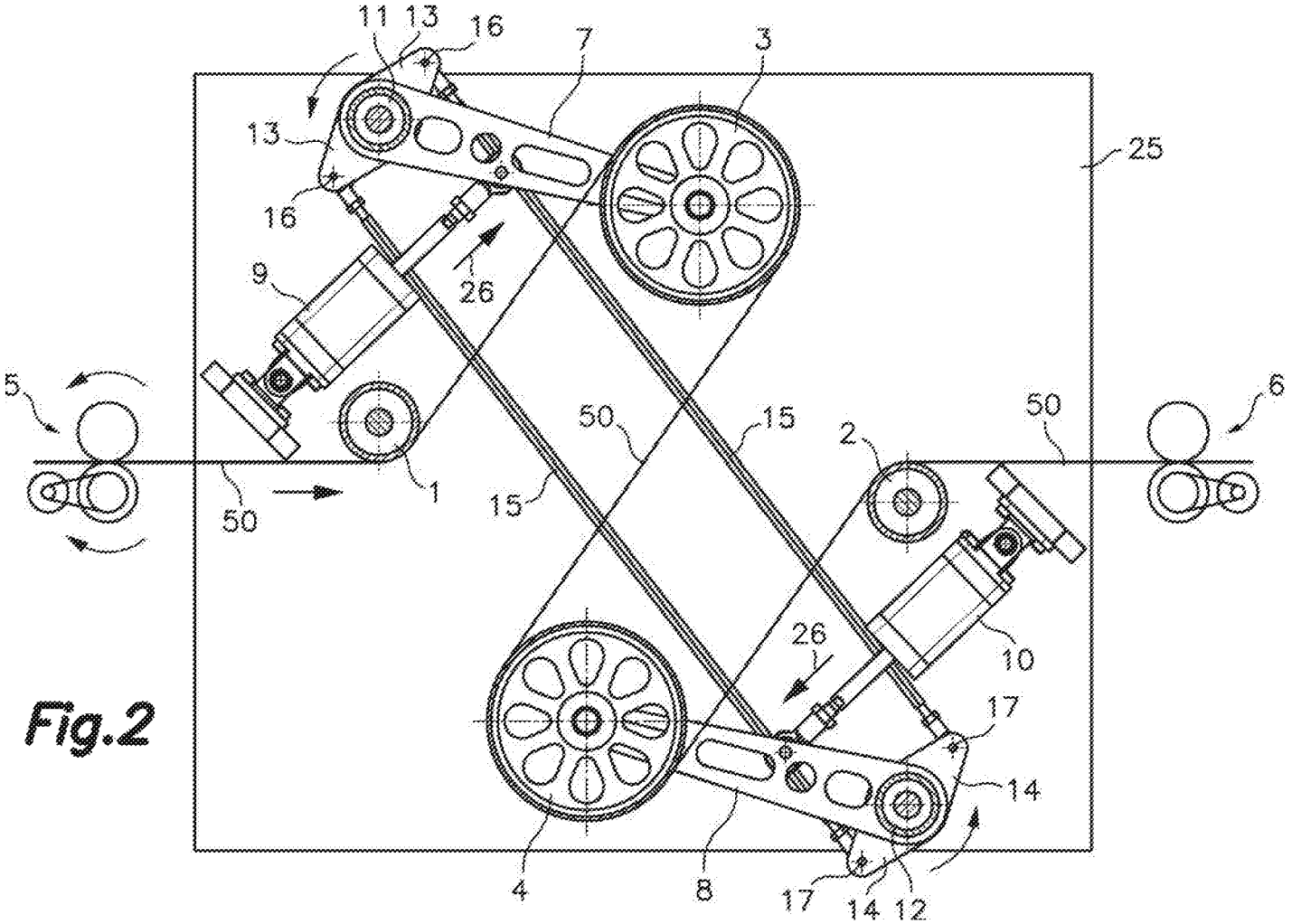
FIGS. 2 and 3 are plan views of the movement compensating device of FIG. 1 in a maximum meander position and minimum meander position, respectively.
Figure 3:
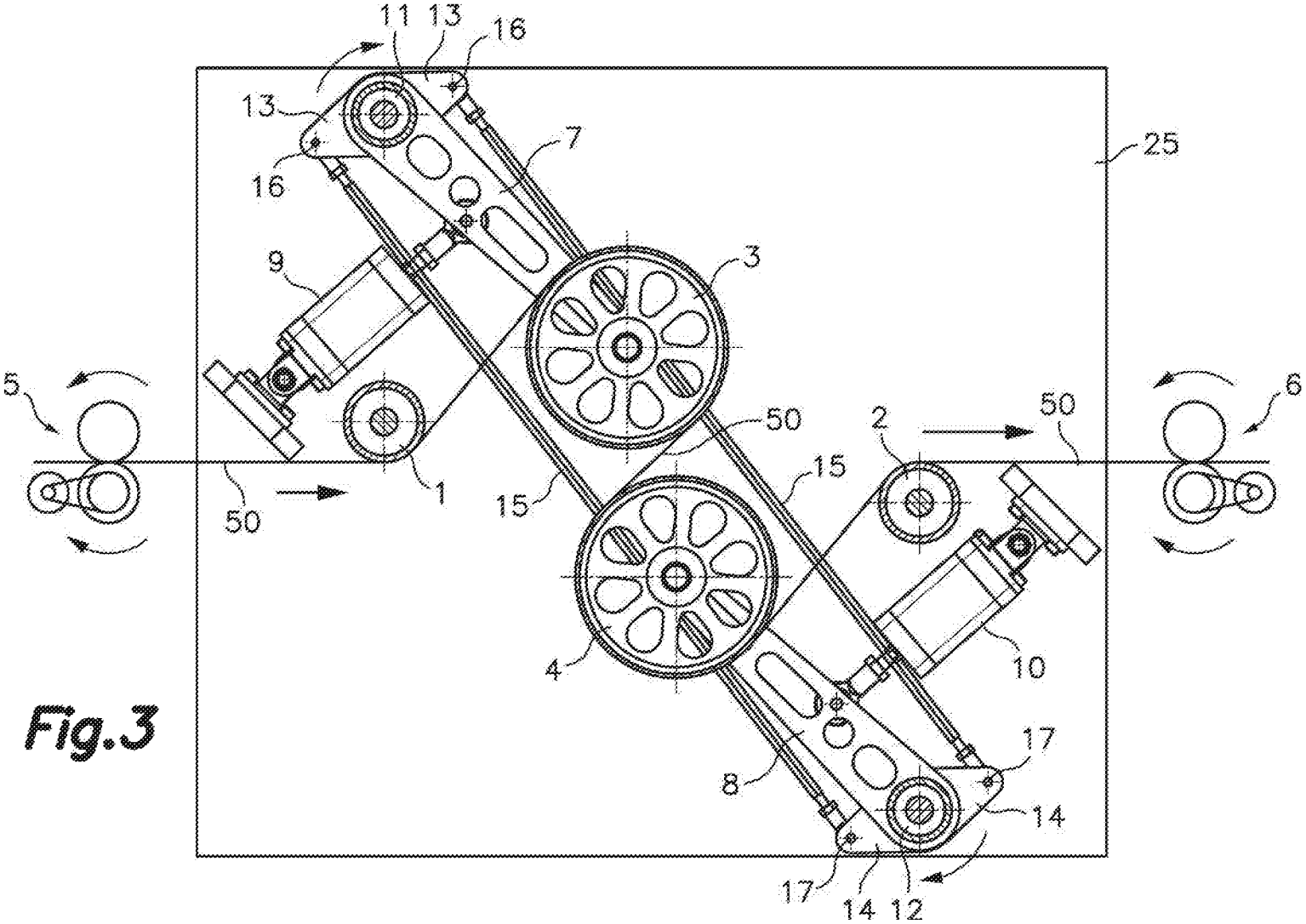

First in reference to FIGS. 1, 2 and 3, reference number 25 indicates a structure on which there is installed a web film movement compensating device for a web film movement compensation between a continuous forward movement section and an intermittent forward movement section according to an embodiment of the present invention. The movement compensating device is useful for an automatic horizontal bag-forming and -filling machine, and comprises first and second guide rollers 1, 2 parallel to one another arranged such that they can rotate freely in stationary positions between a continuous driving device 5 and an intermittent driving device 6 (not shown in FIG. 1).

The movement compensating device further comprises first and second pivoting arms 7, 8 arranged such that they can oscillate about respective pivot shafts 11, 12 parallel to the first and second guide rollers 1, 2, and first and second compensation rollers 3, 4 parallel to the first and second guide rollers 1, 2 installed such that they can rotate freely on the first and second pivoting arms 7, 8, respectively.

In this embodiment, the first pivot shaft 11 is closer to the first guide roller 1 than to the second guide roller 2 on a first side of a geometric plane containing axes of the first and second guide rollers 1, 2, and the second pivot shaft 12 is closer to the second guide roller 2 than to the first guide roller 1 on a second side of the mentioned geometric plane.

Furthermore, the first and second guide rollers 1, 2 and the first and second pivot shafts 11, 12 are arranged in symmetrical positions with respect to an axis of symmetry parallel to and equidistant from the first and second guide rollers 1, 2 and contained in the geometric plane defined above, the first and second compensation rollers 3, 4 have one and the same diameter, and the first and second pivoting arms 7, 8 have one and the same length.

A first elastic element 9 is connected at one end to the structure 25 and at the other end to the first pivoting arm 7, and a second elastic element 10 is connected at one end to the structure 25 and at the other end to the second pivoting arm 8. In this embodiment, the first and second elastic elements 9, 10 are made up of devices with a pneumatic spring arranged such that they drive the first and second pivoting arms 7, 8 and the first and second compensation rollers 3, 4 in respective directions of moving away from the first and second guide rollers 1, 2, indicated by arrows 26 in FIG. 2.

Alternatively, the first and second elastic elements 9, 10 could be made up of tension coil springs, compression coil springs, torsion coil springs, or springs of any other type. In any case, the first and second elastic elements 9, 10 are the same and are arranged symmetrically in relation to the mentioned axis of symmetry.

The movement compensating device includes a movement transmission mechanism transmitting an oscillating movement of the first pivoting arm 7 to the second pivoting arm 8, such that the first and second compensation rollers 3, 4 move closer to one another and away from one another simultaneously. In the variant shown in FIGS. 1, 2 and 3, this movement transmission mechanism comprises first lever arms 13 fixed to the first pivoting arm 7, second lever arms 14 fixed to the second pivoting arm 8, and connecting rods 15 having a first end connected to the first lever arms 13 by first articulations 16 and a second end connected to the second lever arms 14 by second articulations 17.

The first lever arms 13 and the second lever arms 14 have one and the same length, and the connecting rod 15 has a length equal to a distance between the first and second pivot shafts 11, 12. In other words, a distance between each of the first articulations 16 and the first pivot shaft 11 is equal to a distance between each of the second articulations 17 and the second pivot shaft 12, and a distance between the first articulations 16 and the second articulations 17 is equal to the distance between the first and second pivot shafts 11, 12.

In an alternative embodiment (not shown), the movement transmission mechanism comprises a single first lever arm 13, a single second lever arm 14, and a single connecting rod 15, wherein the first and second lever arms 13, 14 have one and the same length and the connecting rod 15 has a length equal to the distance between the first and second pivot shafts 11, 12.

As a result of the action of the movement transmission mechanism, only one of the first or second elastic elements 9, 10 is essential, so the other one can be omitted. However, the inclusion of both the first and second elastic elements 9, 10 is preferable for a more balanced operation.

During operation, a web film 50 (FIGS. 1 and 2), which is moved continuously by the continuous driving device 5 and intermittently by the intermittent driving device 6, is supported on the first and second guide rollers 1, 2 and on the first and second compensation rollers 3, 4, forming a meander. The first and second pivoting arms 7, 8 perform oscillating movements between a maximum meander position (FIG. 2), in which the amount of web film 50 and a minimum meander position (FIG. 3).

A transition between the minimum meander position (FIG. 3) and the maximum meander position (FIG. 2) occurs when the intermittent driving device 6 is stopped while the continuous driving device 5 is working, given that in such a circumstance the web film 50 loses tautness which is compensated for by the force exerted by the first and second elastic elements 9, 10.

A transition between the maximum meander position (FIG. 2) and the minimum meander position (FIG. 3) occurs when both continuous and intermittent driving devices 5, 6 are working, with the intermittent driving device 6 working at a higher speed than the continuous driving device 5, given that in such a circumstance the web film 50 has increased tautness overcoming the force exerted by the first and second elastic elements 9, 10.

The first and second compensation rollers 3, 4 comprise end plates supporting a cylindrical wall between them. Both the end plates of the first and second compensation rollers 3, 4 and the first and second pivoting arms 7, 8 have lightening openings provided for lightening the mass thereof and thereby reducing the inertial forces generated by intrinsic accelerations of the oscillating movement.

The scope of the present invention is defined in the attached claims.

What is claimed is:

1. A web film movement compensating device for a web film movement compensation between continuous forward movement section and intermittent forward movement section for an automatic horizontal bag-forming and -filling machine, comprising:

first and second guide rollers (1, 2) parallel to one another arranged such that they can rotate freely in stationary positions between a continuous driving device (5) and an intermittent driving device (6);

a first compensation roller (3) parallel to said first and second guide rollers (1, 2) installed such that it can rotate freely on a first pivoting arm (7) oscillating about a first pivot shaft (11) parallel to the first and second guide rollers (1, 2);

a second compensation roller (4) parallel to the first and second guide rollers (1, 2) installed such that it can rotate freely on a second pivoting arm (8) oscillating about a second pivot shaft (12) parallel to the first and second guide rollers (1, 2);

a movement transmission mechanism transmitting oscillating movements of the first pivoting arm (7) to said second pivoting arm (8) such that the first and second compensation rollers (3, 4) move closer to one another and to the first and second guide rollers (1, 2) and away from one another and from the first and second guide rollers (1, 2) simultaneously; and an elastic element connected to at least one of said first and second pivoting arms (7, 8) to actuate said first and second compensation rollers (3, 4) in a direction of moving away from one another and from the first and second guide rollers (1, 2);

wherein a web film (50), which is moved continuously by said continuous driving device (5) and intermittently by said intermittent driving device (6), is supported on the first and second guide rollers (1, 2) and on the first and second compensation rollers (3, 4) forming a meander while said first and second pivoting arms (7, 8) performs oscillating movements between a maximum meander position and a minimum meander position, wherein said first pivot shaft (11) is closer to the first guide roller (1) than to the second guide roller (2) on a first side of a geometric plane containing the axes of the first and second guide rollers (1, 2) and said second pivot shaft (12) is closer to the second guide roller (2) than to the first guide roller (1) on a second side of said geometric plane containing the axes of the first and second guide rollers (1, 2); and wherein said movement transmission mechanism comprises a first lever arm (13) fixed to the first pivoting arm (7), a second lever arm (14) fixed to the second pivoting arm (8), and a connecting rod (15) having a first end connected to said first lever arm (13) by a first articulation (16) and a second end connected to said second lever arm (14) by a second articulation (17).

2. The web film movement compensating device according to claim 1, wherein the first and second guide rollers (1, 2) and the first and second pivot shafts (11, 12) are arranged in symmetrical positions with respect to an axis of symmetry that is parallel to and equidistant from the first and second guide rollers (1, 2) and contained in said geometric plane containing the axes of the first and second guide rollers (1, 2).

3. The web film movement compensating device according to claim 1, wherein the first and second compensation rollers (3, 4) have one and the same diameter, and the first and second pivoting arms (7, 8) have one and the same length.

4. The web film movement compensating device according to claim 1, wherein the first and second lever arms (13, 14) have one and the same length and said connecting rod (15) has a length equal to a distance between the first and second pivot shafts (11, 12).

5. The web film movement compensating device according to claim 1, wherein said elastic element is a first elastic element (9) connected to the first pivoting arm (7) to actuate the first compensation roller (3) in a first direction of moving away from the second compensation roller (4) and from the first and second guide rollers (1, 2), and wherein the device further comprises a second elastic element (10) connected to said second pivoting a (8) to actuate said second compensation roller (4) in a second direction of moving away from the first compensation roller (3) and from the first and second guide rollers (1, 2) opposite said first direction of moving away.

6. The web film movement compensating device according to claim 5, wherein the elastic element or each of said first and second elastic elements (9, 10) is selected among a pneumatic spring, a tension coil spring, a compression coil spring, and a torsion coil spring.

* * * * *